US006171545B1

(12) United States Patent
Marmann

(10) Patent No.: US 6,171,545 B1
(45) Date of Patent: Jan. 9, 2001

(54) LANCE HOLDER WITH MULTIPLE FUNCTION GRIPPING HEAD

(75) Inventor: Horst Marmann, Ratingen (DE)

(73) Assignee: Beda-Oxygentechnik Armaturan GmbH, Ratingen (DE)

( * ) Notice: Under 35 U.S.C. 154(b), the term of this patent shall be extended for 0 days.

(21) Appl. No.: 09/267,782

(22) Filed: Mar. 15, 1999

(30) Foreign Application Priority Data

Mar. 23, 1998 (DE) ..... 198 12 460
Jan. 29, 1999 (DE) ..... 199 03 473

(51) Int. Cl.[7] ..... C21C 5/30
(52) U.S. Cl. ..... 266/226; 266/225
(58) Field of Search ..... 266/225, 226, 266/217, 268

(56) References Cited

U.S. PATENT DOCUMENTS 3,972,515 * 8/1976 Mercatoris ..... 266/225
4,083,540 * 4/1978 Berry et al. ..... 266/225
4,732,370 * 3/1988 Berry et al. ..... 266/225
5,131,636 7/1992 Marmann .

FOREIGN PATENT DOCUMENTS 195 47 885 C1 9/1997 (DE) .
0 372 098 11/1993 (EP) .

* cited by examiner

*Primary Examiner*—Scott Kastler
(74) *Attorney, Agent, or Firm*—James Creighton Wray; Meera P. Narasimhan

(57) ABSTRACT

The use of oxygen lance tubes 12 for refining in connection with steel production is simplified and configured more safely in that the sealing casing 14 is allocated a slidable pressure piston 15 in which pressure media act on the pressure casing 14 to a limited extent, thus improving the mounting of the lance tube 12; the latter is fixed from the other side over the pressure casing 4 pushed on to the collet 3. Upon activation of the adjusting facility 11, regardless of whether it is a pneumatic or manually operated adjusting facility 11, the pressure casing 4 slides down from the collet 3 and the interior space 16 is simultaneously connected with the atmosphere through a bypass 17 with a shut-off valve 18. Any excessive oxygen pressure possibly developing here, for example as a consequence of a lance tube 12 blocked by slag, may be rapidly reduced without endangering the operating crew. The doubly secured holder is especially simply constructed in that the pressure piston 15 simultaneously serves as a safety blocking piston 18.

28 Claims, 4 Drawing Sheets

LANCE HOLDER WITH MULTIPLE FUNCTION GRIPPING HEAD

BACKGROUND OF THE INVENTION

The invention concerns a lance holder for oxygen lance tubes with a collet which is adaptable to the diameter of the oxygen lance tube, and of a pressure casing which is arranged on the holder and constructed so as to be slidable longitudinally over the collet with the aid of an adjusting facility, whereby the collet is allocated a deformable sealing casing clamping the lance tube.

Lances with a collet and a pressure casing which is slidable over it serve to hold the lance needing to be refined, and secondly, for example, to assure that the workers operating the lance holder are not in danger when concluding or interrupting the blowing process. Lance holders with a slag run back safety device can be gathered from EP-B1-0 372 098. Here, the pressure casing slides over the collet with the aid of a toggle joint to fix the lance tube. A seal is arranged behind the collet which is squeezed when the collet is slid in order to seal the lance tube tight. Such a lance holder or its collet is in part adapted to various tube diameters, whereby the force necessary for staying leads to the toggle joint often being violently pressed back or struck so that damage to the lance holders occurs. As a consequence, the fixation of the oxygen lance tube is no longer exact. DE-PS-195 47 885 also shows a lance holder allocated to a lance manipulator in connection with which, however, manual labor for staying the oxygen lance tube is largely unnecessary because the pressure casing has available a clamp dog which ensures that an appropriately strong spring then provides for a secure mounting of the lance tube if the clamp dog is released. If a tube end is to be removed and a new oxygen lance tube is to be introduced, compressed air is administered to the clamping piston so that this is pushed against the force of the compression spring. At the same time, the collet is released so that corresponding manipulations become possible. Such a lance holder offers considerable advantages. But the risk of danger to personnel in extreme situations cannot be avoided. Such a threat exists, for example, if the oxygen lance tube is blocked in front, and exists as a rule with slag. When oxygen is delivered, this can then leave the oxygen lance such that a dangerously high pressure builds up in the lance holder and elements associated with it. When the collet is released, a dangerous flying up of the oxygen lance tube or even a springing back of the lance holder occurs.

SUMMARY OF THE INVENTION

Therefore, underlying the invention is the objective of making a lance holder which is to be joined with the lance tube in a simple and safe handling manner, and which is also to be uncoupled from the lance tube again, even with a blocked lance tube and under the action of pressure.

The objective is accomplished in accordance with the invention in that the sealing casing with sealing is arranged in a pressure cylinder which is slidable with limitations longitudinally in the holder and at the same time acting upon the seal, positioned so as to be acted upon by the pressure medium ($O_2$) in the interior, and in that a bypass with safety blocking pistons (which is constructed as unlatchable through the adjustment facility) is provided in front of the pressure piston in the direction of flow of the pressure medium ($O_2$) in the interior of the holder, or connectable with the atmosphere.

It is possible with the aid of a lance holder constructed in this manner to release forced pressure from the interior of the lance holder when the oxygen lance tube is blocked, principally blocked by slag, so that afterward the lance tube can be removed and replaced by a new one without the risk of danger arising. The interior of the lance holder is connected with the atmosphere through a bypass for this purpose, whereby the safety blocking piston in the bypass is unlatched through the adjustment facility which slides or slides back the pressure casing over the collet. This means that the safety blocking piston is automatically opened when the pressure casing slides back so that the oxygen standing in the interior under pressure can flow off. The pressure piston acting upon the sealing casing is moreover subjected to stress by the oxygen and therewith advantageously fixes the lance tube until the pressure buildup in the interior is correspondingly greatly reduced. At the same time, such a pressure piston also operates advantageously by arresting the lance tube during normal operation as well. A mounting of the lance tube additionally securing the lance holder is therewith created which also makes safe handling possible in extreme situations.

According to an appropriate construction of the invention, it is provided that an oxygen stop valve is arranged in front of the pressure piston, advantageously with an integral slag run back safety device. This oxygen stop valve closes off the interior of the lance holder and ensures that oxygen cannot flow back into the lance holder in the event the slag run back safety device is called upon.

As was indicated above, there are several solutions for the activation of the lance mounting. That is, the adjusting facility can be variously constructed but nonetheless accomplish the objective with appropriate finesse. According to an appropriate construction, it is provided that the pressure casing, constructed in two parts, as is known, has a housing with compressed air connection and with a clamp dog releasing the collet against the tension of a tension spring, and that the cylinder space allocated to the clamp dog is connected with the safety blocking piston through a feeder conduit serving as a bypass. The activation of the lance holder takes place, as is known, by the action of compressed air upon the clamp dog. The clamp dog slides against the force of the tension spring and therewith releases the collet so that the lance tube situated in the lance holder can be removed and be replaced by a new one. If now, for example, pressure has built up in the lance holder due to the lance tube being blocked, this is released by force and discharged because the compressed air flows through the cylinder space and the feeder conduit flows into the safety blocking cylinder and opens it. The connection between atmosphere and interior of the lance holder is thereby created and the dangerous excess pressure in the interior of the lance holder can be reduced.

A secure reaction of the safety blocking piston is attained in that the feeder conduit is connected acting upon the locking piston of the safety blocking piston, whereby the locking piston is held in the closed position by a compression spring. The compressed air flowing in through the feeder conduit slides the locking piston against the force of the compression spring and therewith brings it into a closed position. A dangerous excessive pressure in the lance housing can thereby be reduced. In normal operation of the lance holder, the safety blocking piston necessarily remains open until the compressed air supply is stopped and the clamp dog is released. The necessary pressure is therewith lacking in the feeder conduit, and the compression spring can close the closing piston of the safety blocking piston.

Simple and safe handling of such a lance holder is improved in that the compressed air connection on the housing has available a coupling pin which is constructed subject to action over an inserted shut-off coupling. As long as the shut-off coupling is slid up the coupling pin, compressed air can be introduced. If the administration of compressed air is to be concluded, the shut-off coupling is simply withdrawn and the clamp dog is therewith released once again. The shut-off coupling closes automatically so that compressed air no longer flows in.

The sealing casing mentioned above, which is surrounded by the pressure piston and therewith also squeezed by this, ensures that the lance tube is additionally sealed and above all arrested, and also then still held owing to this arresting when the collet must be released to reduce an excessive oxygen pressure in the interior. In a deviation from the state of the art, the sealing casing is squeezed from both sides thanks to special construction so that an absolutely secure mounting or sealing is guaranteed. The sealing casing is first placed under stress by the pressure piston and secondly by the collet. When pressure builds up in the interior when the collet is already released, the pressure piston attends to fixing the lance tube until the pressure has reached a harmless order of magnitude in the interior.

The pressure piston should, as has been mentioned, slide in the direction of the clamp dog and at the same time correspondingly act upon the neoprene seal or sealing casing. It is secured in relation to the partition of the interior since the pressure piston accommodating the sealing casing on the outer wall has a groove, preferably a groove with an O-ring seal. This O-ring seal or O-ring seals permit sliding of the pressure piston without their sealing action being impaired so that they are especially well suited for the use described here.

A mechanical construction is also possible beside the pneumatic construction of the lance holder, which in accordance with the invention has a pressure casing which is constructed so as to be slidable on the collet with the aid of toggle joint, or constructed so as to be capable of sliding below it, whereby the pressure piston accommodating the sealing casing is arranged acting on bypass pistons of the safety blocking piston, and in connection with which the bypass piston sealing element blocking off the bypass pistons with the bypass is acted upon by a compression spring securing the valve opening position. With the aid of a construction of this type, it is also possible in connection with such a mechanical configuration to fix the lance tube and at the same time to release pressure from the interior when the lance tube is blocked, for example. This is ensured as follows: the toggle joint first of all pushes the pressure casing from the collet and moreover at the same time ensures, by releasing the collet, that the pressure piston accommodating the sealing casing pushes from behind, squeezes the sealing casing, and fixes the lance tube. The bypass piston of the safety valve slides into the space free from the receding pressure piston, thereby at the same time releasing the bypass between interior and atmosphere so that the excessive oxygen pressure in the interior can be reduced. Once this has taken place, the pressure piston ensures that the bypass pistons once again slide into the blocking sealing element so that the sealing element once again locks in accordance with the outflow. In this connection, it is advantageous that a mechanical solution is also possible which remains sufficiently easy to move and nonetheless ensures that in such extreme situations, the lance tube remains fixed until it can be removed from the lance holder without danger.

A beneficial accommodation of the compression spring through which the sealing element acts in a blocked or blocking manner is the one in connection with which the compression springs are arranged in front of the sealing element surrounding the bypass pistons and bracing themselves against the reverse side of the pressure piston on the one hand and against the annular wall of plug bore holes for the bypass pistons. The compression springs can therewith advantageously support the opening process, while the sealing element operates automatically when the bypass piston is pressed into the closed position through the pressure piston. Even then, if one or several of the bypass pistons should hook slightly, this compression spring ensures that in such case the oxygen can correspondingly flow off through the sealing element.

It is provided in accordance with an appropriate construction that the sealing element is constructed as a sealing ring sealing against the bypass piston. This way it is assured that, via a slight sliding movement, the bypass piston has already opened the safety blocking piston sufficiently far that a pressure reduction may take place.

In order to prevent dirt from entering the area of the sealing element experiencing rough operation, it is provided that the sealing element is assigned to an outlet opening in which a contamination safety device is arranged. This contamination safety device permits the oxygen to flow off, especially when this stands under excessive pressure, but prevents dust or coarser elements from being able to enter the outlet opening.

The flowing off of oxygen into the interior of the lance holder can be advantageously undertaken in connection with the mechanical solution on the shortest path since the bypass is made of radial bore holes which connect the interior with the plug bore holes at the level of the pressure casing in which the bypass pistons are slidably arranged. Oxygen consequently always occurs in an appropriate amount in this area and ensures that the pressure piston acts correspondingly, bracing on the pressure casing. At least this function is supported. On the other hand, however, the oxygen can flow off by the shortest path if the problem described should occur since the oxygen can not flow off through the lance tube.

It has already been mentioned above that the blocking action of the pressure piston can be supported by proper construction, for which it is advantageous if the plug bore holes are constructed so as to play-guide the bypass pistons along and/or to have parallel channels. Even in normal operation, the oxygen may be passed under the pressure pistons through the plug bore holes or, above all, through the parallel channels such that a secure mounting of the lance tube is supported.

It is advantageous in connection with the solution described above if the pressure piston is constructed framing the sealing casing and the collet. This way, influencing the pressure casing is further optimized in order to assure the fixation of the lance tube. The collet itself is selectively guided in the pressure piston in order to contribute to the "deformation" of the sealing casing and thus to fix the lance tube securely and to seal off.

The oxygen required for the activity described is supplied to the lance holder through a hose; this hose is to be manipulated only with an appropriate expenditure of force due to the prevailing pressure and its special construction. Since it is connected with the lance holder, it can restrict its mobility. This is especially relevant when excessive pressure arises in the lance holder due to a blocked lance tube and also in the hose connection or in the oxygen lance hose. In order to avoid these problems, the invention provides for a swivel joint with ball bearing guide to be arranged between the holder with a hose connection and the oxygen lance hose. This swivel joint can in any given case be brought into a position which prevents impairing the freedom of movement of the lance holder because the oxygen lance tube is held in an appropriate direction.

A quasi-automatic adaptation is ensured in that the swivel joint has a connection piece which automatically adapts to the momentary angle of operation of the oxygen lance hose. This connection piece at all times pivots about the swivel joint such that the oxygen lance hose is held optimally in each case; that is, so that it does not restrict the freedom of motion of the lance holder and so that it is not bent or folded. Regarded overall, a basically better handling possibility results for such a lance holder whether it is allocated to a lance manipulator or is handled directly by the workers.

A configuration of the lance holder which is advantageous from the perspective of construction provides that the pressure casing is built so as to be slidable on the collet through the toggle joint, so that the pressure piston is acted upon through a compression spring arranged in a spring space connected with the interior in the direction of the opening of the pressure casing, and so that the spring space is connected with the bypass constructed directly in front of the O-ring seal serving as a safety blocking piston through a plug boring. In this way, expensive valves, appropriately separated bypasses and other elements complicating the construction of the lance holders are advantageously omitted because in accordance with the invention the pressure piston proper is now at the same time built as a type of valve. The oxygen gas pressure which may still exist in the lance holder ensures that the pressure piston is slid so far with the internal sealing casing and seal that the O-ring seal provided permits passage of the oxygen gas present in the direction of the pressure casing. At the same time, the oxygen gas still standing under pressure can be discharged into the atmosphere past the collet. Here it is especially advantageous that the oxygen gas still standing under pressure is not discharged crosswise from the lance holder, but rather in front of the head so that risk of danger to the operating personnel can be totally eliminated. The oxygen exits at the front of the pressure casing such that the operators cannot stand or be active in any way in the area of the emerging gas. Moreover, the compression spring arranged in the spring space serves to support the pressure piston, which ensures that oxygen gas will be led off even in small amounts such that a risk of danger can no longer arise from it. This takes place through the fact that the compression spring ensures that the pressure piston is slid and at the same time slides the O-ring so far that the oxygen gas can flow past it. This way, the advantage is retained that when the oxygen lance tube is slid in, this is first fastened through the collet, and secondly through the pressure piston acted upon by oxygen gas with the correspondingly deformed seal in the sealing casing.

To enable the oxygen gas to flow off in the area of the O-ring seal in a short period of time, it is provided that the pressure piston is constructed having a return starting at the O-ring seal at the end pointing toward the opening, thus producing an outlet. As soon as the O-ring seal of the pressure piston has crossed over the return, the oxygen gas present can consequently flow out, and then leaves the pressure piston area through the outlet in order to reach further into the atmosphere through the pressure casing. Moreover, the point at which the gas may flow out can be determined more exactly if, in accordance with a refinement of the invention, pressure pistons and the holder housing are shaped forming one return each, whereby these two returns correspond to each other. At the same time, the return formed in the holding housing or in the interior wall of the holder housing is important because this allows gas to flow out of the bypass after passing over the O-ring seal. The return on the pressure piston optimizes this.

The oxygen gas leaving the pressure piston first passes into a type of antechamber surrounding the collet to flow from there past the collet into the atmosphere. If the collet sits directly and firmly on the pressure casing for any reason, then the slot for the outflowing gas is not large enough, such problems may be rectified by arranging axial bore holes connecting the antechamber and the outlet in the pressure casing with the atmosphere. This may involve two or even an entire ring of axial bore holes which connect the antechamber and the atmosphere. Since contamination is really not to be feared here, it is not absolutely necessary to provide a screen. A screen may, however, be inserted into the axial boring so that dirt cannot unintentionally enter the pressure casing area or into the antechamber area.

When sliding the pressure piston, the O-ring seal is slid out over the guide of the interior wall of the holder housing. In order to prevent the O-ring seal from sliding out, it is provided that the O-ring seal and groove are constructed yielding a pressure seal.

When the pressure piston is slid back, the seal of the pressure casing should slide the collet along, whereby burdening the seal made of flexible material is quite possible because the pressure piston has an anti-spread device framing the seal. The anti-spread device provides a type of channel with the interior wall of the pressure casing into which the appropriate seal is inserted.

The use or manufacture of the pressure piston is simplified in that the pressure piston is constructed in two parts, whereby an annular element has the anti-spread device and the reverse side supports the compression spring as well as connection bore holes to the bypass, while a casing element is outfitted with plug bore holes proceeding from the connection bore holes and the bypass is constructed as a radial bore hole as well as the groove. The two construction units may be assembled in such a way that the annular element constitutes a disk with the anti-spread device while the casing element represents the piston action with the O-ring seal used in the groove, and such that the annular element and casing element are constructed as insertable into each other, thereby clamping the seal between casing element and anti-spread device.

As was mentioned above, the seal is clamped over the interior wall of the casing element and the anti-spread device, whereby this seal is framed from both sides as the sealing casing is constructed bracing and guiding into the outer wall of the seal, and the anti-spread device is constructed lying on the inner wall of the seal.

The invention is distinguished by the fact that a lance holder is created which can be advantageously manipulated even in unfavorable working positions and situations. A solution is specified in connection with a blocked lance tube which leads to an automatic reduction of pressure in the lance holder interior. That means that the operating crew itself need not react to this situation at all. The lance holder itself ensures that the pressure reduction diminishes if the adjusting facility of the lance holder is activated in order to remove the lance tube. It is also especially advantageous in this connection that the solution described may be used in connection with a pneumatic construction of a lance holder of this type as well as in connection with a purely mechanical construction. It is assured in both cases that upon activation of the adjusting facility, thus with supplying compressed air or upon activation of the toggle joint, the pressure casing is slid down by the collet and at the same time a bypass is opened through a safety blocking piston which forces a rapid outflow of oxygen from the interior of the lance holder. Thanks to this forced venting and multiple function adjusting facility, secure operation is possible even with somewhat inexperienced operating crews. In a particularly simple construction, the pressure piston at the same time takes over the action of the safety blocking piston as the pressure piston slides over the plug borehole and a radial bore hole as bypass then allows the oxygen gas to flow past the O-ring seal so that it can reach the atmosphere.

Further details and advantages of the object of the invention emerge from the subsequent description of the associated drawings in which the necessary details and individual elements of a preferred embodiment is represented, wherein:

DETAILED DESCRIPTION

Figure 1:
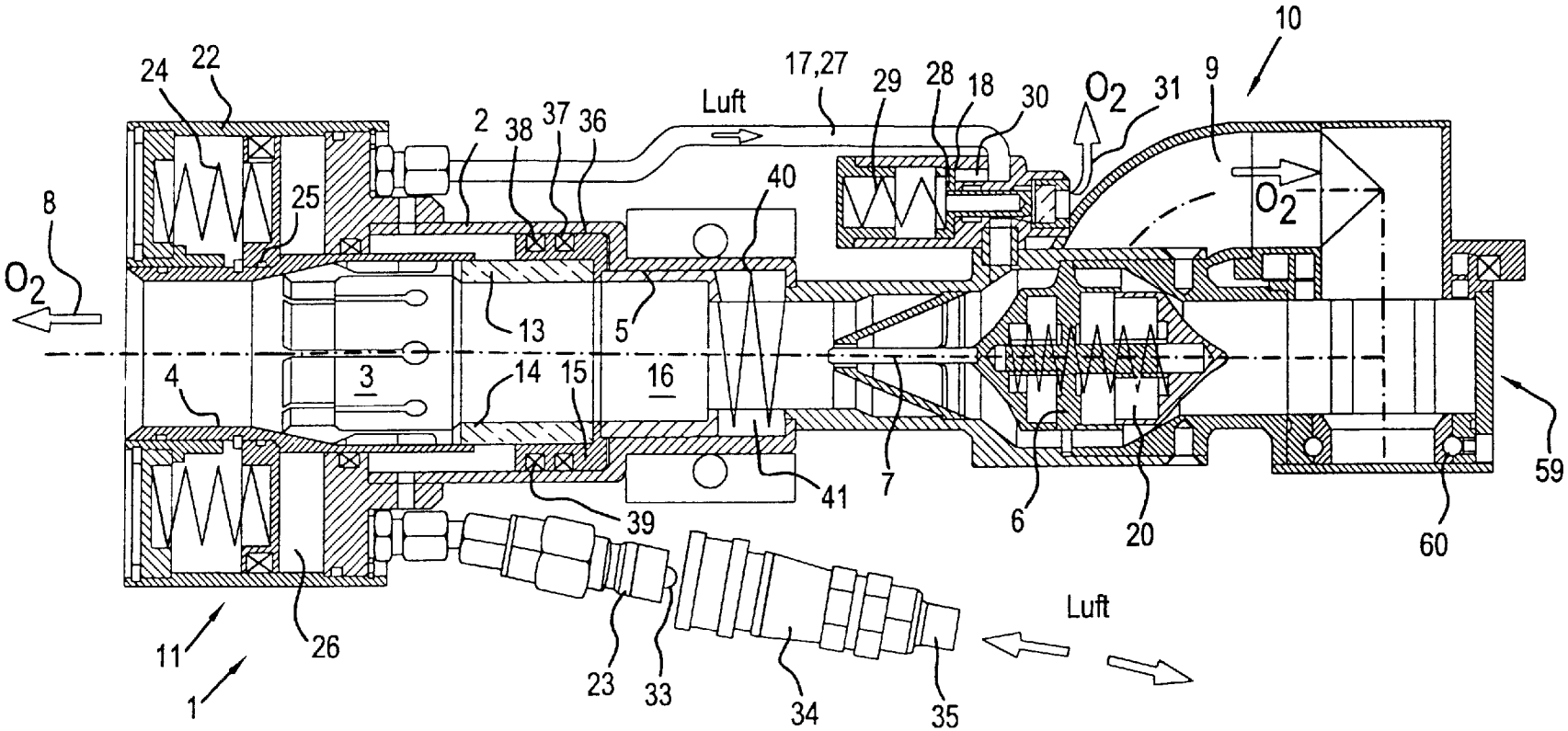
FIG. 1 depicts a lance holder with pneumatic adjustment facility in cross section.

FIG. 1 shows a lance holder system where detachment of the lance tube takes place pneumatically and fastening of the lance tube takes place by spring force.

The holder 1 for the lance tube 12 has available a tubeshaped holder housing 2 with the collet 3 and the pressure casing 4 which can be slid over it. As can be seen, the collet 3 can slide slightly in the direction of the buffer casing 5 in order to stay the sealing casing 14 or seal 13.

A slag back run safety device 6 is installed in the holder housing 2 which serves here as an oxygen stop valve 20 at the same time or is correspondingly constructed. The slag run back safety device 6 responds through the thermal release 7 if liquid slag should penetrate into the holder housing 2, whereby the oxygen lance hose 9 is connected in the longitudinal direction 8 of the holder housing 2 behind the slag run back safety 6 of the oxygen lance hose 9. Here a special construction of the hose connection 10 described further below is realized.

An adjustment facility is designated generally with 11 being a pneumatic adjustment facility with the configuration or construction according to FIG. 1. The oxygen lance tube 12 which is reproduced in FIG. 3 may be fastened or released through the collet 3 and the pressure casing 4.

The pressure casing 14 is accommodated in a pressure piston 15 for additional securing of the lance tube 12, which is slidable longitudinally 8 in the holder housing 2 and which further stays the sealing casing 14 or seal 13 and ensures that these are placed tightly and holding onto the lance tube 12.

The interior space 16 of the holder housing 2 is connected with the atmosphere through a safety blocking piston 18. If excessive pressure arises in the interior 16, this pressure can be reduced through the bypass 17. Further explanations follow below.

With the pneumatic execution according to FIG. 1, the pressure casing 4 is arranged over a housing 22 with a compressed air connection 23 and a tension spring 24. The tension spring 24 ensures that in the pressureless state, the clamp dog 25 and therewith the pressure casing 4 slide in the direction of the collet 3 in order to clamp the lance tube 12 with this. At the same time, the pressure medium which flows through the clamped lance tube 12 ensures that the pressure casing 14 is moved in the opposite direction, like the collet 3, in the area in front of the enclosure of the lance tube 12. An additional clamping of the sealing casing 14 and an even better fastening of the lance tube 12 takes place as a result.

Should the remaining piece of a used lance tube 12 be removed, compressed air introduced from the air hose 35 is passed through the compressed air connection 23 after pressing the coupling pin 33 through the shut-off coupling 34. This slides the clamp dog 25 against the tension spring 24 together so that at the same time the pressure casing 4 is also moved back in order to release the collet. The lance tube 12 can then be removed.

Since the cylinder space 26 is connected with the locking piston 28 of the safety blocking piston 18 through the feeder conduit 27, this safety blocking piston 18 is also opened at the same time. The compressed air from the feeder conduit 27 presses the locking piston 28 out against the compression spring so that the plunger 30 releases the outlet 31. overpressure air or correspondingly highly stressed oxygen which may be present in the interior 16 of the holder housing 2 can then enter the atmosphere through the bypass 17 and the outlet 31.

Such a situation can occur if the lance tube 12, not represented in FIG. 1, is blocked at its free end with cooled slag. Excessive pressure then builds up in the interior 16 which cannot reach a dangerous level because after the excessive pressure arises, the adjustment facility 11 is set on open as the clamp dog 25 is provided with compressed air from the compressed air connection 23. At the same time this pressure opens, as described above, the safety blocking piston 18 or slides its closing piston 28 so that the excessive pressure in the interior 16 is very rapidly reduced because the oxygen flows out over the short bypass 17 and the outlet 31.

Figure 2:
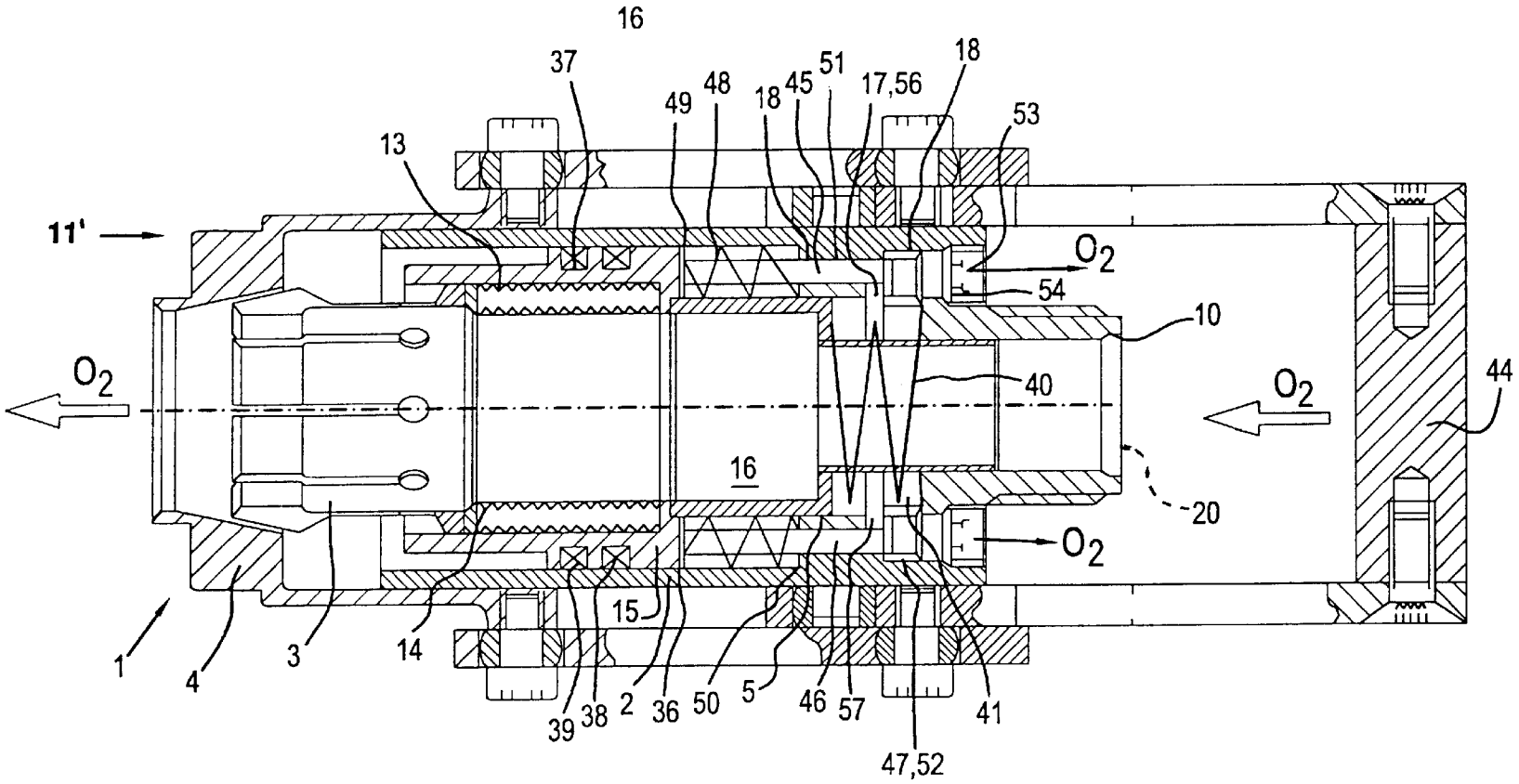
FIG. 2 illustrates a lance holder with hand lever adjustment facility in cross section.

The holder 1 according to FIG. 2 is in principle constructed identically to the one according to FIG. 1, only that here a mechanical adjustment facility 11' is realized. Even here, the sealing casing 14 or seal 13 is mounted in a pressure piston 15 or surrounded by the latter so that the seal 13 is correspondingly deformed when this pressure piston is moved and pressed against the lance tube 12 (not represented here) particularly since, as is easily recognizable, the collet 3 may be slid over the pressure casing 4 and the adjustment facility 11 in the direction of the sealing casing 14. Just as in the construction according to FIG. 1, a groove 37 or a double groove 38 is also formed in the outer wall 36 of the pressure piston 15 in which an O-ring seal 39 is arranged.

A buffer casing 5 is arranged behind the sealing piston 15 which is slidable over a spiral spring 40, likewise in the direction of the sealing casing 14. This buffer casing 5 is constructed in both cases such that an annular space 41 is formed whereby the bypass 17 begins in the form of radial bore holes 56, 57 and said bypass is connected to the safety blocking piston 18.

The pressure casing 4 is shifted to the collet 3 through the toggle joint 44 for staying the lance tube 12 (not depicted here), so that the lance tube 12 is clamped. At the same time, the collet 3 slides, as already described, in the direction of the sealing casing 14 which correspondingly clamps the lance tube 12 with the pressure casing 4. This clamping is then still favored when oxygen is administered in that the pressure piston 15 slides against the direction of sliding of the collet 3 in order to clamp the sealing casing 14 or the sealing effectively.

When staying the collet 3, the pressure piston 3 presses with its reverse side 49 on bypass pistons 45, 46 against the force of compression springs 48. These are pushed by the sealing element(s) 47 so that oxygen cannot escape into the atmosphere through the bypass 17 and the outlet opening 53. oxygen can, however, slip through the bypass 17 and then along the plug bore hole 51 past the bypass pistons 45, 46 to a limited extent and exert pressure on the pressure pistons 15 so that the staying of the lance tube 12 over the sealing casing 14 is improved. This is still supported by the compression spring 48 which is clamped between the ring wall 50 of the plug bore holes 51 and the reverse side 49 of the pressure piston 15.

If the lance tube 12 is now to be detached and removed from the holder 1, the pressure casing 4 is withdrawn from the collet 3 through the toggle joint 44. The pressure piston 15 with sealing casing 14 follows this movement favored by the compression spring 48 so that the bypass pistons 45, 46 also move out of the sealing element 47 or the sealing ring 52 and release the outlet opening 53. Oxygen can be discharged by the shortest path out of the interior 16 to reduce possible excessive pressure in the interior 16 rapidly.

A contamination safety 54 is arranged in the outlet opening 53 which prevents pressure from reaching into the area of the sealing ring 52 or the sealing element 47 through the outlet opening 53. This ensures permanent functioning of the safety blocking piston 18.

Figure 3:
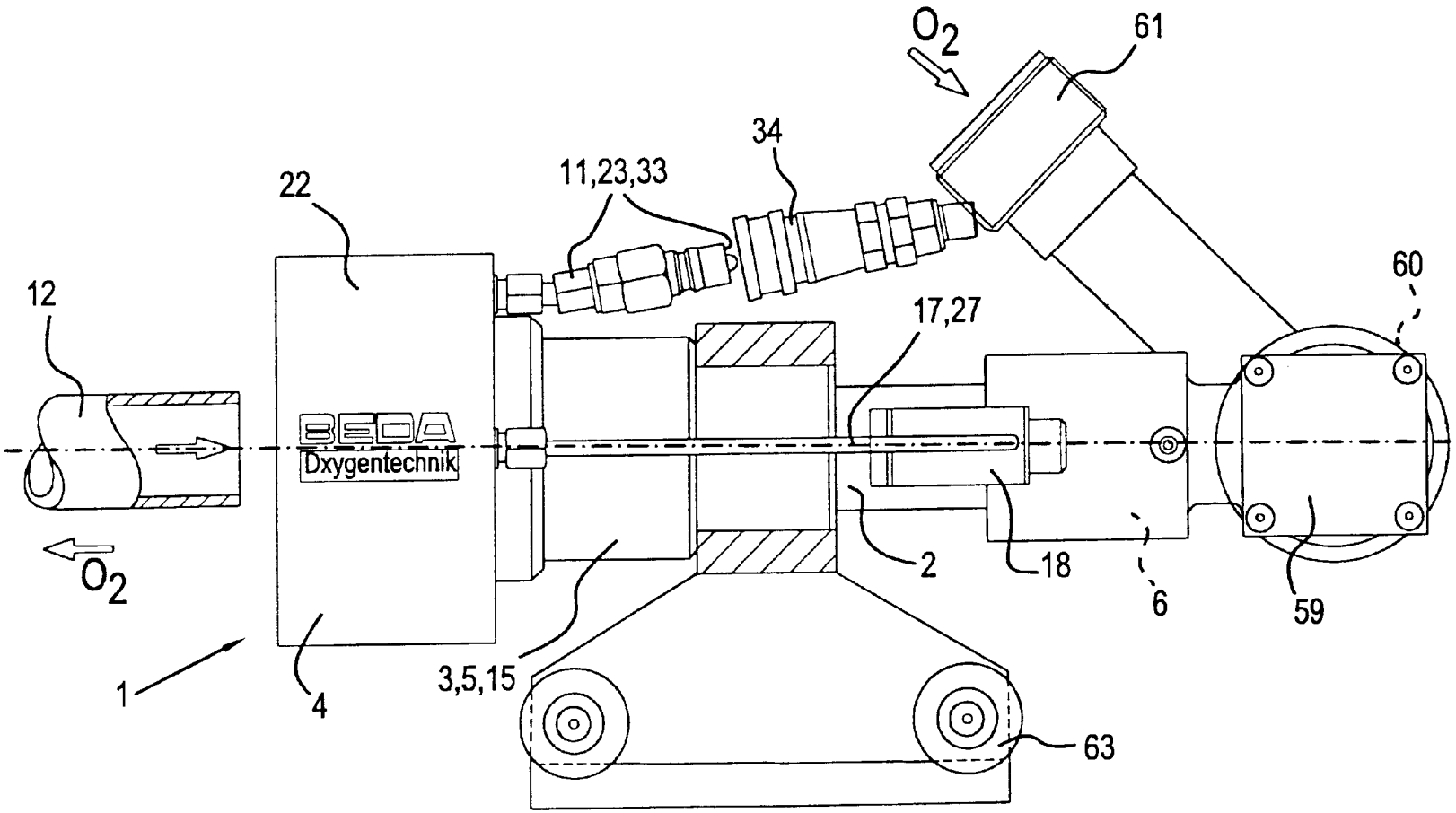
FIG. 3 shows a plan view of the construction according to FIG. 1 with attached swivel joint.

FIG. 3 illustrates a side view of the holder 1 with the holder housing 2, whereby the laterally arranged safety blocking piston 18 is recognizable. A swivel joint 59 with ball bearing guide 60 serves for connection with the oxygen lance hose 9 whereby the connection piece 61 automatically adapts to the respective position or the momentary operating angle of the oxygen lance hose 9.

The traversing drive is designated with 63 through which the entire holder 1 may be slid back and forth in a corresponding guide.

Thanks to the secure holding of the blocked lance tube 12 and the forced pressure release described, the previously known initial valve additionally allocated to the slag run back safety device 6 may be omitted. Through this and further simplifications, more oxygen is available in any given case so that working cycles can be shortened. In addition, another safety function is engaged in connection with the thermal release triggered by slag run back, since a complete pressure release of the system from tube removal is registered up to the oxygen stop valve 20. Furthermore, it is advantageous that an automatic adaptation to available tube tolerances is reached without requiring involvement of the operating crew. Even when the uncoupling process is inadvertently and perhaps prematurely introduced in connection with the occurrence of excess pressure, the lance tube 12 is blocked by the described pressure piston 15/sealing casing 14 fixation to the extent that the lance tube 12 can first be removed when the pressure reduction in the holder housing 2 has ended. This automatic pressure release upon uncoupling the holder 1 by selective pressure equilibrium is especially advantageous if lance tube 12 is blocked by slag and the like or has a closed front opening. The lance holder system described is to be realized with hand lever activation, thus by activation through toggle joint 44 as well as with compressed air activation of the clamp dog 25, so that a multiple function activation results. Finally, it should be stressed as an advantage that a swivel joint 59 is arranged at the end facing the oxygen lance hose 9 which enables an optimal adaptation of the lance holder-hose connection to the momentary operating angle of the oxygen lance hose 9.

Figure 4:
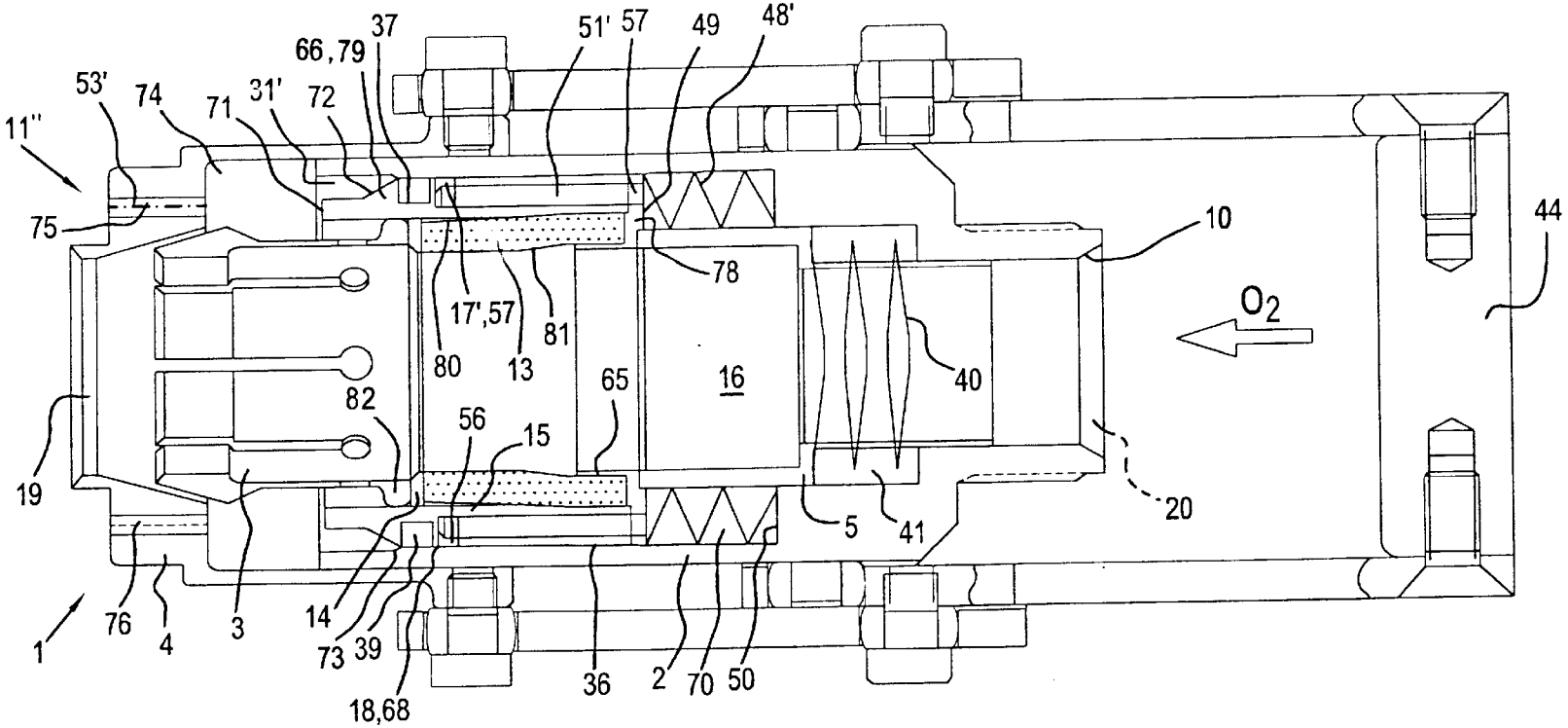
FIG. 4 presents a lance holder with hand lever adjustment facility with pressure piston serving as safety blocking piston.

FIG. 4 corresponds to the basic structure of the construction illustrated in FIG. 2 whereby pressure piston 15 is jointly used as a type of safety blocking piston 18. For this, it is first of all provided that the buffer casing 5 is surrounded by an annular space in which the compression spring 48 is arranged. For this reason, this area is also designated as the spring space 70. The oxygen gas $O_2$ present can consequently leave the area of the spiral spring 40 to the buffer casing 5 along the spring space 70. Since the pressure piston 15 is outfitted with connection bore hole 67 and plug bore holes 51', the oxygen gas reaches groove 37 and the O-ring seal 39. The plug bore holes 51' end here with a bypass 17/57; that is, the bypass 17 is here constructed as radial bore hole 57 or 56. Oxygen gas ($O_2$) is therefore present here and ensures that the entire pressure piston 15 slides such that the clamped seal 13 of the sealing casing 14 is deformed. Owing to the deformation of the seal, the inserted oxygen lance tube 12 is additionally fixed.

If the pressure casing 4 is now removed from the collet 3 by activation of toggle joint 44, the remaining part of the oxygen lance tube 12 may be removed, whereby any oxygen possibly still present makes itself felt in that the pressure piston 15 slides further so that the O-ring seal 39 slides away through the return 72 or 73, so that the oxygen gas can escape into the atmosphere through the outlet 31' and the antechamber 74 and the axial bore holes 75, 76.

The corresponding returns 72, 73 are constructed at the end 71 of the pressure piston 15 in the direction of the opening 19 of the pressure casing 4. Their position and construction is clearly recognizable in FIG. 4. As soon as the O-ring seal 39 has passed over these returns 72, 73, the flowing off of the oxygen gas occurs. The system is then released again. The O-ring seal 39 is arranged in groove 37 whereby the corresponding partition of the bypass 17' acts as a type of safety shut-off element 68.

The seal 13 or the sealing casing 14 and pressure piston 15 are especially constructed for their optimal guidance. The pressure piston 15 consists of an annular element 78 and a casing element 79 which are constructed so as to be insertable into one another, whereby the ring element 78 has connection bore holes 67 and moreover the anti-spread device 65 which guides the lower end of seal 13 together with the interior wall of the casing element 79. The seal 13 is correspondingly clamped with inner wall 81 and outer wall 80 through this, and the sealing casing 14 provides for an appropriate insertion and guidance of seal 13 at the opposite end of the seal 13. The end element of the casing element 79 is a type of counterpart 66 which projects correspondingly far into the antechamber and once again guides the support ring 82 of the collet 3.

All features mentioned, even those to be gathered from the drawings alone, are viewed as basic to the invention alone and in combination.

What is claimed is:

1. Lance holder apparatus for oxygen lance tubes comprising an oxygen lance tube, a collet adaptable to a diameter of the oxygen lance tube, a holder, a pressure casing on the holder, an adjuster connected to the pressure casing for positioning the pressure casing slidably over the collet, a deformable sealing casing for the collet, a seal on the deformable sealing casing for clamping the lance tube, a pressure piston for receiving the sealing casing with the seal, the sealing casing and the seal being slidable with a longitudinal restriction in the holder acting on the seal, a pressure medium of $O_2$ for acting on the seal positioned in an interior space of the holder, and a bypass with safety block pistons provided in front of the pressure piston in a flow of the pressure medium in the interior space or connectable with atmosphere being unsealable by the adjuster.

2. The apparatus of claim 1, further comprising an oxygen check valve in front of the pressure cylinder.

3. The apparatus of claim 2, wherein the oxygen check valve has an integral slag run back safety device.

4. The apparatus of claim 1, wherein the pressure casing further comprises two parts forming a housing having a compressed air connection, a tension spring, a clamp dog provided in a cylindrical area of the housing for relieving the collet against tension of the tension spring, and a feeder conduit forming the bypass for connecting the clamp dog with the safety block piston.

5. The apparatus of claim 4, further comprising a locking piston connected to the safety block piston, a compression spring connected to the locking piston for holding the locking piston in a locked position, and wherein the feeder conduit is adapted for exerting an influence on the locking piston.

6. The apparatus of claim 3, wherein the compressed air connection on the housing has a shut-off coupling inserted therein and a coupling pin influenced through the shut-off coupling.

7. The apparatus of claim 1, wherein the sealing casing is a neoprene sealing.

8. The apparatus of claim 1, wherein the pressure piston has a groove on an exterior wall.

9. The apparatus of claim 8, wherein the groove is a double groove further comprising an O-ring seal.

10. The apparatus of claim 1, further comprising a toggle joint on the pressure casing for slidably moving the pressure casing on the collet, bypass pistons in the safety block pistons communicating with the pressure piston, and a bypass blocking sealing element and a compression spring for securing a valve opening position and providing stress on the bypass pistons, the bypass, and the sealing.

11. The apparatus of claim 10, wherein the compression spring surrounds the bypass pistons and has one side positioned against a reverse side of the pressure piston and another side positioned against a ring partition of plug bore holes for the bypass pistons provided in front of the sealing element.

12. The apparatus of claim 10, wherein the sealing element is a seal for sealing against the bypass pistons.

13. The apparatus of claim 10, wherein the sealing element has an outlet opening, comprising a contamination safety device in the outlet opening.

14. The apparatus of claim 10, further comprising a buffer casing and wherein the bypass has radial bore holes and plug bore holes, the radial bore holes connecting the interior space at a level of the buffer casing with the plug bore holes, and wherein the bypass pistons are slidably arranged in the plug bore holes.

15. The apparatus of claim 14, wherein the plug bore holes play-guide the bypass pistons.

16. The apparatus of claim 14, wherein the plug bore holes have parallel channels.

17. The apparatus of claim 1, wherein the pressure piston frames the sealing casing and the collet.

18. The apparatus of claim 1, further comprising a hose connection to the holder and an oxygen lance hose, and a swivel joint with a ball bearing guide arranged between the holder with the hose connection and the oxygen lance hose.

19. The apparatus of claim 18, wherein the swivel joint has a connection piece automatically adaptable to momentary operating angles of the oxygen lance tube.

20. The apparatus of claim 1, wherein the pressure casing is slidable on the collet through a toggle joint, and the pressure piston is under stress through a compression spring arranged in a spring space connected with the interior space in a direction of an opening of the pressure casing, and the spring space is joined with the bypass directly in front of an O-ring seal serving as safety blocking piston through a plug borehole.

21. The apparatus of claim 20, wherein the pressure piston has a return starting on the O-ring seal at an end pointing towards the opening for predetermining an outlet.

22. The apparatus of claim 1, further comprising axial bore holes arranged in the pressure casing for connecting an antechamber and an outlet with the atmosphere.

23. The apparatus of claim 21, wherein the O-ring seal and the groove create a pressure ring sealing.

24. The apparatus of claim 1, wherein the pressure piston has an anti-spread device.

25. The apparatus of claim 24, wherein the pressure piston has two parts, an annular element having the anti-spread device and a reverse side supporting a compression spring and connecting bore holes to the bypass, a casing element outfitted with plural plug bore holes proceeding from the connecting bore holes, wherein the bypass is constructed as a radial bore hole and the groove.

26. The apparatus of claim 1, wherein pressure piston and the holder are shaped for forming one return each.

27. The apparatus of claim 25, wherein the annular element and the casing element are insertable into each other, and wherein the seal is a clamp between the casing element and the anti-spread device.

28. The apparatus of claim 25, wherein the sealing casing is constructed to support and guide an outer wall of the seal and wherein the anti-spread device is constructed for lying on an interior wall of the seal.

* * * * *